US005117728A

United States Patent [19]

Shibukawa et al.

[11] Patent Number: 5,117,728

[45] Date of Patent: Jun. 2, 1992

[54] SOFT PEDAL EFFECT APPLYING APPARATUS

[75] Inventors: Takeo Shibukawa; Hidemichi Kimura; Tokuji Hayakawa, all of Hamamatsu, Japan

[73] Assignee: Yamaha Corporation, Hamamatsu, Japan

[21] Appl. No.: 370,384

[22] Filed: Jun. 22, 1989

[30] Foreign Application Priority Data

Jun. 23, 1988 [JP] Japan ..... 63-156417

[51] Int. Cl.[5] ..... G10H 1/46

[52] U.S. Cl. ..... 84/633

[58] Field of Search ..... 84/615, 622-625, 84/633, 653, 658-661, 665, 678, 687-690, 692, 699, 700, 721, 746

[56] References Cited

U.S. PATENT DOCUMENTS

| | | | |
|---|---|---|---|
| 4,248,123 | 2/1981 | Bunger et al. | 84/678 |
| 4,552,051 | 11/1985 | Takeuchi | 84/687 X |
| 4,713,996 | 12/1987 | Oguri | 84/622 |
| 4,779,505 | 10/1988 | Suzuki | 84/622 |
| 4,909,121 | 3/1990 | Usa et al. | 84/622 X |

FOREIGN PATENT DOCUMENTS

| | | |
|---|---|---|
| 55-38333 | 3/1980 | Japan . |
| 61-172192 | 8/1986 | Japan . |

*Primary Examiner*—W. B. Perkey
*Attorney, Agent, or Firm*—Graham & James

[57] ABSTRACT

A soft pedal effect applying apparatus is utilized in an electronic musical instrument in order to apply a soft pedal effect to a musical tone to be generated when a soft pedal is operated, wherein this soft pedal effect is set quite similar to that of a non-electronic musical instrument such as a grand piano. Before operating the soft pedal, a generated musical tone has a reference tone volume and a reference tone color which are determined based on a touch operation intensity applied to a depressed key in a keyboard. By operating the soft pedal, a tone volume of the generated musical tone is softened due to the soft pedal effect by slightly lowering the tone volume by the predetermined tone volume attenuation value, wherein this lowered tone volume can be clearly discriminated from the reference tone volume. Such attenuation value can be arbitrarily varied in response to the tone volume level. In addition, a tone color of the generated musical tone is softened due to the soft pedal effect by giving a desirable filter characteristic to the tone color, wherein this softened tone color is different from the reference tone color. Thus, when the soft pedal is operated, the tone volume and the tone color of the generated musical tone are independently softened.

5 Claims, 6 Drawing Sheets

TONE VOLUME CONVERSION DATA TABLE VOLTBL(TCH)

FILTER CHARACTERISTIC TO BE SELECTED

TONE COLOR CONVERSION DATA TABLE BANKTBL(TCH)

SOFT PEDAL EFFECT APPLYING APPARATUS

BACKGROUND OF THE INVENTION

1. Field of the Invention

The present invention relates to a soft pedal effect applying apparatus, and more particularly to a soft pedal effect applying apparatus which is suitable for controlling a tone color and a tone volume of a musical tone to be generated by operating a soft pedal.

2. Prior Art

The conventional electronic musical instrument provides the so-called soft pedal as a pedal operating means. There are two kinds of pedal effect apparatuses conventionally proposed, wherein a first pedal effect apparatus (as disclosed in Japanese Utility-Model Laid-Open Publication No. 55-38333) controls an amplitude characteristic of a musical tone waveform by operating the soft pedal and a second pedal effect apparatus (as disclosed in Japanese Patent Laid-Open Publication No. 61-172192) controls and varies touch control quantity in response to the operation of the soft pedal.

In general, a grand piano as a non-electronic musical instrument provides a mechanism corresponding to the pedal effect applying apparatus by which when the pedal is depressed by a player's foot, a string hammering mechanism of the piano is slightly shifted such that the number of strings to be hammered is decreased. Due to this mechanism, it is possible to vary the tone color to be generated into the soft tone color. In the conventional upright piano, the hammers are moved closer to the strings in response to the depression of pedal so that the acceleration of hammer is decreased, whereby the pedal effect is applied to the musical tone.

The above-mentioned non-electronic musical instrument can obtain the variation of musical tone by the pedal effect applying apparatus, wherein such variation includes the variation of tone color in addition to the variation of tone volume. However, the conventional pedal effect applying apparatus of the electronic musical instrument can not obtain the musical tone applied with the pedal effect which is sufficiently similar to that of the non-electronic musical instrument.

It is accordingly a primary object of the present invention to provide a soft pedal effect applying apparatus whose pedal effect is quite similar to that of the non-electronic musical instrument such as the grand piano, upright piano and the like.

It is another object of the present invention to provide a soft pedal effect applying apparatus capable of independently controlling the tone volume and tone color of the musical tone to be generated when operating the soft pedal.

In a first aspect of the present invention, there is provided a soft pedal effect applying apparatus which includes both tone volume and tone color softening means operable in response to the operation of a soft pedal, wherein the tone volume is reduced by a predetermined amount from a value which it would have if the soft pedal were not operated, and the tone color is made softer by a predetermined degree with respect to a tone color which would be generated if the soft pedal were not operated. By independently controlling the tone volume and tone color in this respect, more realistic soft pedal effects can be achieved.

In a second aspect of the invention, a soft pedal effect is provided in which tone volume is reduced in response to application of the soft pedal and the amount of volume reduction is greater for softer tones as compared to the amount of volume reduction for relatively louder tones. In this fashion, the change in tone volume caused by operating the soft pedal is readily perceptible.

In a third aspect of the invention, a soft pedal effect is provided by changing tone color and switching from a selected filter characteristic corresponding to touch intensity to a different filter characteristic when the soft pedal is operated to provide a softer tone.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF A PREFERRED EMBODIMENT

Basic Configuration and Operation of the Present Invention

First, description will be given with respect to the basic configuration and operation of the present invention.

The soft pedal effect applying apparatus of the electronic musical instrument applies the soft pedal effect to the musical tone to be generated by operating the soft pedal (3). In a first example of the present invention, when soft pedal operation detecting information (SOFT) is obtained, tone volume softening process means (5, LOOP1) forms tone volume control information (VEL-3.0 to VEL-12.0) for decreasing the tone volume (VEL) of the generated musical tone by the predetermined amount of tone volume. In addition, when the soft pedal operation detecting information (SOFT) is obtained, tone color softening process means (5, LOOP2) forms tone color control information (BANK-1) for softening the tone color of generated musical tone. Due to such tone volume control information and tone color control information, the tone volume and tone color of the generated musical tone are respectively varied from the reference tone volume and reference tone color which are determined based on the non-operation state where the soft pedal is not operated.

In a second example of the present invention, the tone volume softening process means further forms another tone volume control information based on touch detecting information TCH indicative of a touch operation quantity for a key (2). When the touch operation quantity becomes smaller while it is in the relatively small quantity, this another tone volume control information controls the tone volume of the generated musical tone to become lower.

In short, when the player operates the soft pedal, the tone volume softening process means and tone color softening process means are respectively activated so that the tone volume and tone color of the generated musical tone can be independently varied. Thus, the soft pedal effect applying apparatus according to the present invention can obtain the soft pedal effect which is further similar to that of the non-electronic musical instrument as compared to the conventional apparatus.

DESCRIPTION OF AN EMBODIMENT

(1) Configuration of an Embodiment

Next, description will be given with respect to the configuration of a soft pedal effect applying apparatus according to an embodiment of the present invention.

Figure 1:
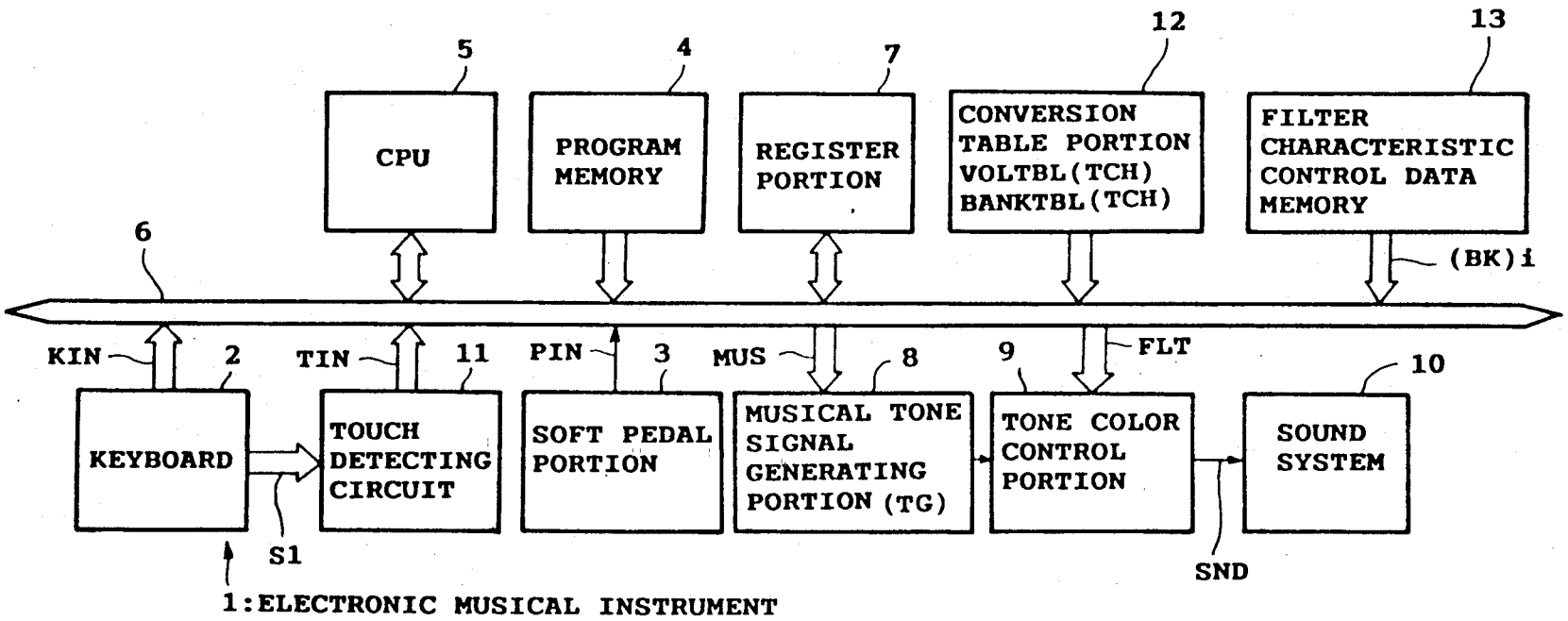
FIG. 1 is a block diagram showing the whole configuration of the electronic musical instrument including the soft pedal effect applying apparatus according to an embodiment of the present invention.

FIG. 1 shows the whole configuration of the electronic musical instrument including the soft pedal effect applying apparatus according to an embodiment of the present invention. In FIG. 1, 1 designates an electronic musical instrument, wherein a central processing unit (CPU) 5 inputs key information KIN from a keyboard 2 and soft pedal information PIN from a soft pedal portion 3 to thereby execute a main routine RTO shown in FIG. 3 based on program data which are stored in a program memory 4 configured by a read-only memory (ROM). At the same time, a register portion 7 configured by a random-access memory (RAM) inputs these information KIN and PIN via a bus 6.

In the present embodiment, the electronic musical instrument 1 is designed such that it can simultaneously generates sixteen musical tones, for example. When plural keys of the keyboard 2 are depressed simultaneously, the CPU 5 assigns each data of the depressed keys to each of sixteen time slots, so that the musical tone signal forming process is executed by use of the time slots in the time sharing manner.

The CPU 5 forms and then supplies musical tone signal control information MUS to a musical tone signal generating portion (TG) 8 via the bus 6. Thus, the musical tone signal generating portion 8 generates and then supplies a musical tone signal SND to a sound system 10 via a tone color control portion 9 which is configured by a digital filter. Based on the musical tone signal SND, the sound system 10 can simultaneously generate the plural musical tones corresponding to the depressed keys.

In addition, each key of the keyboard 2 provides a touch sensor consisting of a key-depression speed detecting element. This touch sensor outputs a touch detection output S1 to a touch detecting circuit 11 when the corresponding key is depressed. The touch detecting circuit 11 converts the touch detection output S1 from each key to be depressed into touch detection information TIN indicative of the depression intensity applied to each key by the player, whereby this touch detection information TIN is sent to the CPU 5 via the bus 6.

When certain key is newly depressed (so that new key event is occurred), the CPU 5 assigns the depressed key to certain tone-generation channel based on the key information KIN from the keyboard 2. Based on the touch detection information TIN of the assigned tone-generation channel, the CPU 5 reads tone volume conversion data from a tone volume conversion data table VOLTBL(TCH) within a conversion table portion 12 to thereby form the tone volume control information, which is then sent to the musical tone signal generating portion 8 as the musical tone signal control information MUS. At the same time, the CPU 5 reads tone color conversion data from a tone color conversion table BANKTBL(TCH) within the conversion table portion 12 to thereby form filter characteristic selecting information. Based on this filter characteristic selecting information, the CPU 5 reads the corresponding filter characteristic control data (BK)i from a filter characteristic control data memory 13. Then, this filter characteristic control data (BK)i is supplied to the tone-color control portion 9 as tone color control information FLT.

(2) Operation of an Embodiment

In order to independently control the tone volume and tone color based on the touch detection information TIN, the CPU 5 executes the following processes.

Figure 2:
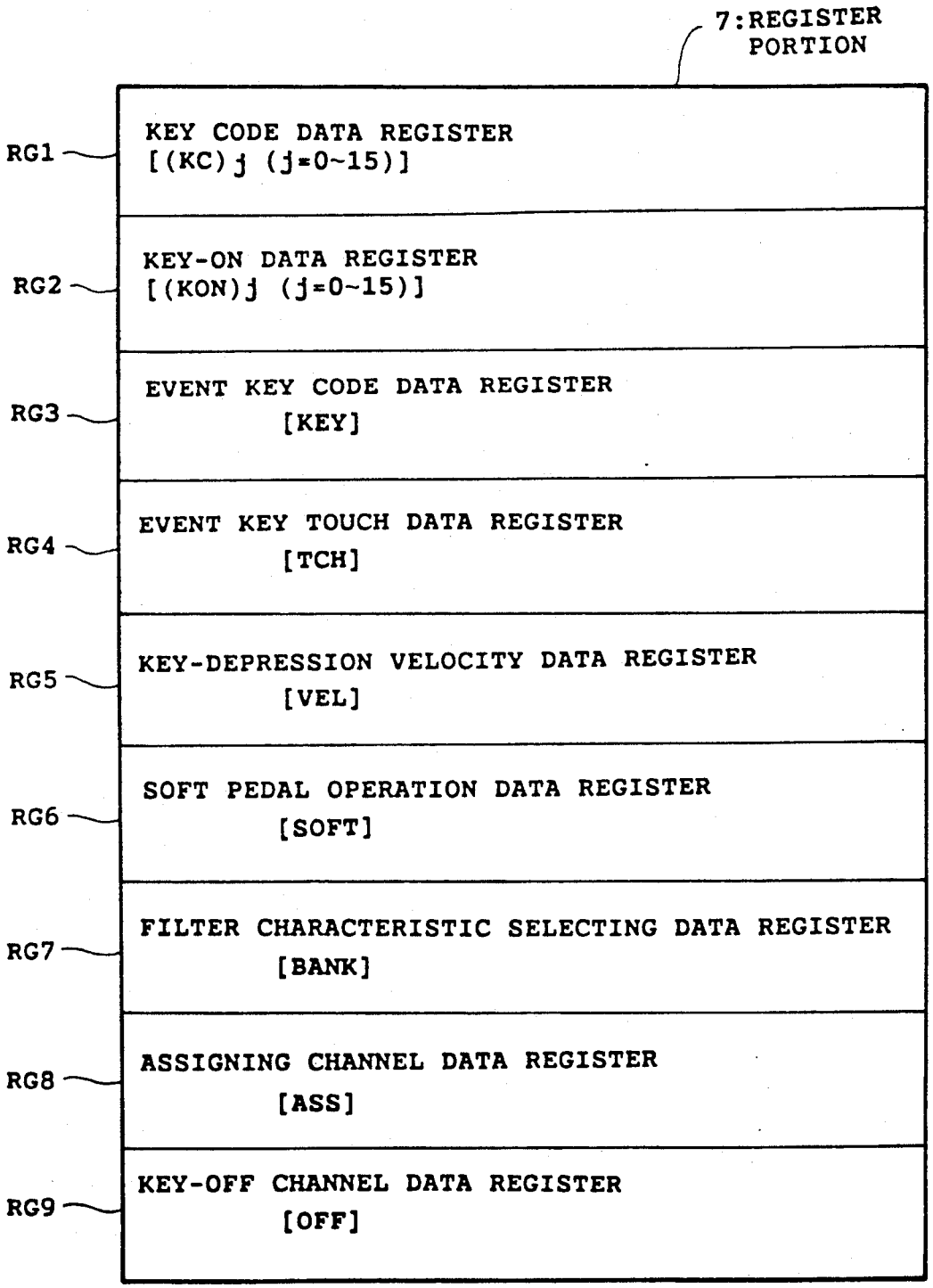
FIG. 2 is a diagram showing a detailed configuration of a register portion shown in FIG. 1.

When the electronic musical instrument 1 is activated, the CPU 5 starts to execute the processes in the main routine RTO (shown in FIG. 3), wherein it initializes the whole portions of the electronic musical instrument 1 in step SP1. At this time, all registers in the register portion 7 (see FIG. 2) are reset.

In next step SP2, based on the soft pedal information PIN from the soft pedal portion 3, the CPU 5 judges whether or not the soft pedal is operated on. If the judgement result of step SP2 is "YES", the processing proceeds to step SP3 wherein soft pedal operation data SOFT having the logical value "1" is written into a soft pedal operation data register RG6 in the register portion 7.

On the other hand, if the judgement result of step SP2 is "NO", the processing proceeds to step SP4 wherein another soft pedal operation data SOFT having the logical value "0" is written into the soft pedal operation data register RG6.

Thereafter, based on the key information KIN from the keyboard 2, the CPU 5 judges whether or not there exists a key event in step SP5. When the judgement result of step SP5 is "YES", the processing enters into a key-on event process subroutine RT1 (shown in FIG. 4).

Through this key-on event process subroutine RT1, the key on which the key-on event is occurred is assigned to the tone-generation channel. Thereafter, the CPU 5 controls the tone volume of the generated musical tone to be smaller in response to the soft pedal operation and touch operation of key. In addition, the CPU 5 controls the tone color to be softened.

On the other hand, when the judgement result of step SP5 (see FIG. 3) is "NO", the CPU 5 jumps over the key-on event process subroutine RT1 to advance to next step SP6.

In this step SP6, the CPU 5 judges whether or not there exists the key to be released. When the judgement result of step SP6 is "YES", the processing proceeds to a key-off event process subroutine RT2 (see FIG. 5) wherein the key-off process is executed on the tone-generation channel to which the released key is assigned.

On the other hand, when the judgement result of step SP6 is "NO", the CPU 5 jumps over the key-off event process subroutine RT2 to advance to next step SP7.

In this step SP7, the CPU 5 executes other processes wherein the player executes the process of changing over the tone color or the CPU 5 executes the process which is done when the volume control (not shown) is operated, for example. After completing the process of step SP7, the processing returns to the foregoing step SP2. Thus, by repeatedly executing the circulating loop consisting of the processes of steps SP2 to SP7 etc., the key-on or key-off process is executed every time the new key-on or key-off event is occurred.

(i) Key-On Event Process

When entering into the key-on event process subroutine RT1 (shown in FIG. 4), the processing first proceeds to step SP11 wherein based on the key information KIN (see FIG. 1), the key code of the key on which the key-on event is occurred is written into an event key code data register RG3 (see FIG. 2) as event key code data KEY. In addition, based on the touch detection information TIN from the touch detecting circuit 11 (see FIG. 1), the key-depression intensity (i.e., touch intensity) for the key on which the key-on event is occurred is written into an even key touch data register RG4 (see FIG. 2) as event key touch data TCH.

In next step SP12, the CPU 5 selects the most-attenuated musical tone among the musical tones of No. 0 to No. 15 tone-generation channels, whereby the number of tone-generation channel corresponding to the selected musical tone is written into an assigning channel data register RG8 (see FIG. 2) as assigning channel data ASS. Thus, the following processes are executed on the tone-generation channel indicated by the above assigning channel data ASS.

At first, in step SP13, by using the event key touch data TCH stored in the event key touch data register RG4, the CPU 5 reads the data from the tone volume conversion data table VOLTBL(TCH) in the conversion table portion 12, and the read data is then written into a key-depression velocity data register RG5 (see FIG. 2) as key-depression velocity data VEL.

In the present embodiment, the tone volume conversion data table VOLTBL(TCH) converts the touch detection information TIN into the event key touch data TCH indicative of touch intensity data which can designate one hundred and twenty eight touch intensity stages, i.e., "0" to "127". The key-depression velocity data VEL=0 (dB) indicative of the reference tone volume having 0 (dB) is assigned to the touch intensity data "127". Based on this, the attenuation in the tone volume when the event key touch data TCH which varies as TCH="127" to "0" is converted into the key-depression velocity data VEL="0" to "−48" (dB). In this sense, as TCH becomes smaller, the key-depression intensity becomes weaker, i.e., the key-depression velocity becomes slower.

Thus, it is possible to designate the key-depression velocity data VEL as attenuation value (dB) with respect to the reference tone volume in response to the variation of event key touch data TCH due to the player's touch operation of the key. Hence, it becomes possible to control the tone volume of the generated musical tone in response to the touch operation (i.e., the key-depression speed).

In next step SP14, the CPU 5 judges whether or not the soft pedal operation data SOFT written in the register RG6 takes the logical value "1". When the judgement result step SP14 is "YES" so that the on-operation of the soft pedal in the soft pedal portion 3 is confirmed, the processing proceeds to the tone volume softening process loop LOOP1 wherein the tone volume of the musical tone to be generated is softened.

In respective steps SP21, SP22, SP23 and SP24 to be sequentially executed, it is judged whether or not the value of event key touch data TCH is larger than predetermined threshold values "48", "32", "24" and "16". If the judgement result of step SP21, SP22, SP23 or SP24 is "NO", the processing proceeds to its next step SP22, SP23, SP24 or SP29. Through these judging processes, the CPU 5 can confirm that the value of event key touch data TCH is more than "48" or in the range of "48" to "32", "32" to "24", "24" to "16", or less than "16".

When the above-mentioned confirmation is obtained (i.e., the judgment result of step SP21, SP22, SP23, SP24 turns to "YES"), the processing proceeds to its next step SP25, SP26, SP27, SP28 respectively, the predetermined operation is executed so that the key-depression velocity data VEL set in the register RG5 in the foregoing step SP13 is reduced by the attenuation value of −3.0 (dB), −4.5 (dB), −6.0 (dB), −9.0 (dB), −12.0 (dB). Then, the reduced key-depression velocity data is rewritten into the register RG5 as the new key-depression velocity data VEL. Thus, the value of event key-touch data TCH (i.e., the tone volume of the generated musical tone corresponding to the touch operation quantity) is controlled to be lowered.

By executing the above-mentioned ton volume softening process loop LOOP1, the CPU 5 can control the tone volume of the generated musical tone as described above. So, while the touch operation quantity is in the relatively small quantity range, the CPU 5 controls the tone volume to be small (or weak) so that the soft effect can be applied to the musical tone to be generated.

Figure 6:
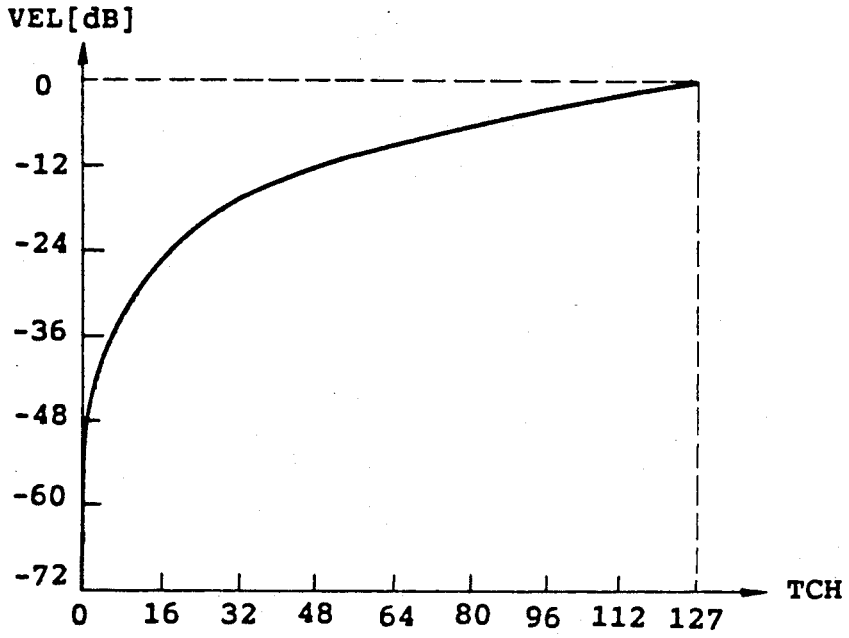
FIG. 6 is a graph showing a characteristic curve which is used for explaining a tone volume conversion table utilized for tone volume softening control.

As described before, the event key touch data TCH can take any one of one hundred and twenty eight stage values "0" to "127" as shown in FIG. 6. On the other hand, the reference threshold value "48" set in step SP21 is set as nearly a half of the maximum value "127" of the event key touch data TCH. In addition, other threshold values "32", "24", "16" set in steps SP22, SP23, SP24 correspond to the further small touch operation quantities.

As described heretofore, when the player makes the touch operation by the small touch operation quantity, the tone volume of the generated musical tone is lowered by −3.0 (dB), −4.5 (dB), −6.0 (dB), −9.0 (dB), −12.0 (dB) as the performance effect corresponding to the soft pedal. Due to this operation, it is possible to obtain the soft pedal effect by which the tone volume can be softened (or weakened) to the extent that the listener can clearly discriminate the softened musical tone from the original musical tone.

After executing the operation process of the tone volume softening process loop LOOP1, when the judgement result of step SP14 turns to "NO" again, the processing proceeds to the next process of step SP31.

In this step SP31, the CPU 5 reads filter characteristic selecting data BANK from the tone color conversion data table BANKTBL(TCH), wherein this data BANK corresponds to the event key touch data TCH written in the register RG4. Then, this read data BANK is written into a filter characteristic selecting data register RG7.

Figure 7:
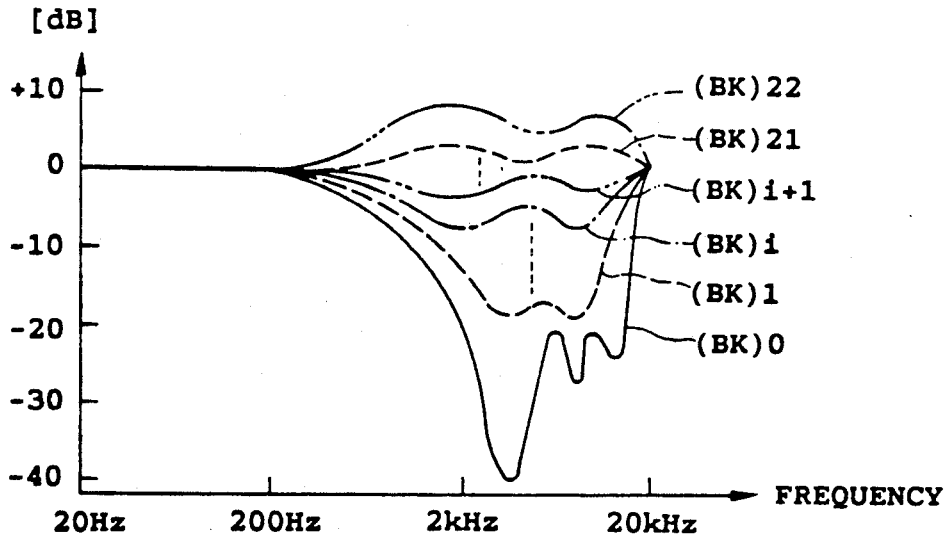
FIG. 7 is a graph showing several curves indicative of filter characteristic control data which are used for tone color softening control.

In the present embodiment, the filter characteristic control data memory 13, as shown in FIG. 7, pre-stores filter characteristic control data (BK)i (where i=0 to 22) by which any one of twenty three kinds of frequency characteristics can be applied to the musical tone signal SND. Each filter characteristic control data (BK)i can be selected and then read out by designating its filter characteristic number i.

By using the filter characteristic selecting data BANK stored in the register RG7, the CPU 5 accesses to the memory area corresponding to the filter characteristic number i in the filter characteristic control data memory 13.

Figure 8:
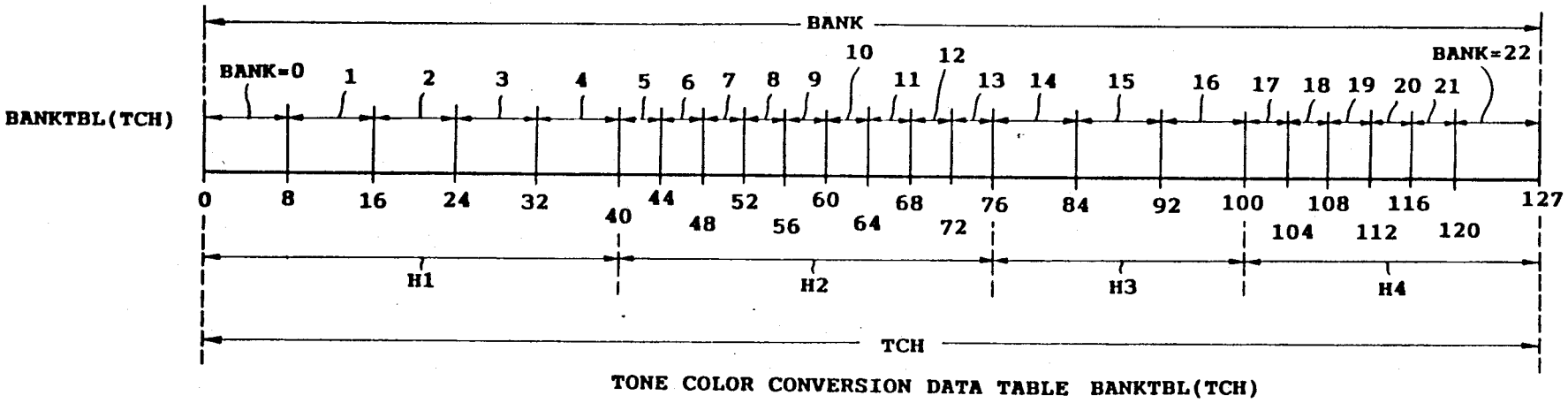
FIG. 8 is a diagram for showing relations between event key touch data TC and filter characteristic selecting data BANK in a tone color conversion data table.

As shown in FIG. 8, the value range of the event key touch data TCH is divided into four ranges H1, H2, H3, H4 in the tone color conversion data table BANKTBL(TCH) within the conversion table portion 12. In the first range H1, the range of TCH=0 to 40 is further divided into five small ranges 0 to 8; 8 to 16; 16 to 24; 24 to 32; 32 to 40, wherein the filter characteristic selecting data BANK=0, 1, 2, 3, 4 are respectively assigned to these five small ranges.

Similarly, in the second range H2, the range of TCH=40 to 76 is further divided into nine small ranges 40 to 44, 44 to 48; . . . ; 72 to 76, wherein the filter characteristic selecting data BANK=5, 6, . . . . 13 are respectively assigned to these nine small ranges.

In the third range H3, the range of TCH=76 to 100 is further divided into three small ranges 76 to 84; 84 to 92; 92 to 100, wherein the filter characteristic selecting data BANK=14, 15, 16 are respectively assigned to these three small ranges.

In the fourth range H4, the range of TCH=100 to 127 is further divided into six small ranges 100 to 104; 104 to 108; 108 to 112; . . . ; 120 to 127, wherein the filter characteristic selecting data BANK=17, 18, . . . . 22 are respectively assigned to these six small ranges.

Then, when the event key touch data TCH takes any one of the values TCH=0 to 127, the CPU 5 reads the filter characteristic selecting data BANK=i (where i=0 to 22) corresponding to such data TCH from the tone color conversion data table BANKTBL(TCH). By using this filter characteristic selecting data BANK, the CPU 5 can designate the filter characteristic control data (BK)i corresponding to the present event key touch data TCH (see FIG. 7).

In the present embodiment, the value of event key touch data TCH obtained from the touch information TIN may tend to belong to the second range H2 frequently. Under such circumstance, the assigning range of the filter characteristic selecting data BANK is set fine (i.e., relatively many small ranges are provided in the second range H2). Due to such division of value range of data BANK, the memory capacity used for the tone color conversion data table BANKTBL(TCH) can be utilize effectively.

In addition, when the event key touch data TCH to be entered into the fourth range H4 is obtained, it can be sensed that the intense touch operation should be made. In case of such intense touch operation, the assigning range of the filter characteristic selecting data BANK is also set fine, thus it is possible to control the tone color of the musical tone fine.

Meanwhile, in step SP32 succeeding the foregoing step SP31 (see FIG. 4), the CPU 5 judges whether or not the soft pedal operation data SOFT stored in the register RG6 takes the logical value "1". When the soft pedal in the soft pedal portion 3 is operated so that judgement result of step SP32 is "YES", the processing enters into the tone color softening process loop LOOP2.

This tone color softening process loop LOOP2 executes the processes by which the tone color of the musical tone to be generated is softened. In first step SP33, the CPU 5 judges whether or not the filter characteristic number i of the data BANK stored in the register RG7 takes the value "0". When BANK equals not "0" (i.e., the judgement result of step SP33 is "NO"), the processing proceeds to step SP34 wherein the value "1" is subtracted from the value of filter characteristic selecting data BANK so that new data BANK-1 is obtained. Such new data BANK-1 is the rewritten into the register RG7 as the new filter characteristic selecting data BANK.

On the other hand, when the soft pedal is not operated on so that the judgement result of step SP32 is "YES", the CPU 5 jumps over the tone color softening process loop LOOP2 to advance to the next step SP35.

Therefore, when the soft pedal is operated in the state where the event key touch data TCH is converted into the corresponding filter characteristic selecting data BANK, the tone color softening process loop LOOP2 executes the process by which the value of filter characteristic selecting data BANK is shifted by one stage value under control of the CPU 5. In other words, the tone color control state based on the filter characteristic control data (BK)i is varied such that the tone color of the musical tone to be generated is softened by one tone color stage.

Incidentally, when the judgement result of step SP33 is "YES", the touch operation is not made. At this time, the CPU 5 jumps over the process of step SP34 to advance to the next step SP35.

In this step SP35, based on the filter characteristic selecting data BANK stored in the register RG7, the CPU 5 reads the corresponding filter characteristic control data (BK)i from the filter characteristic control data memory 13 and this read data (BK)i is then supplied to the tone color control portion 9. By this data (BK)i, the state of the tone color control portion 9 is set to the state where the musical tone signal SND can be varied in response to the on/off operation of the soft pedal.

Thereafter, the processing proceeds to step SP36 wherein the CPU 5 accesses to the memory area of No. j channel (where j=0 to 15) in the whole memory area of key-on data register RG2, wherein this No. j channel is designated by the assigning channel data ASS stored in the register RG8. Then, the key-on data (KON)j having the logical value "1" is written into the accessed memory area.

At the same time, the CPU 5 accesses to the memory area of No. j channel in the key code data register RG1, whereby the key code KEY is written into this accessed memory area as key code data (KC)j.

In next step SP37, under control of the CPU 5, the event key code data KEY in the register RG3, the key-depression velocity data VEL in the register RG5 and the assigning channel data ASS in the register RG8 are all transferred to the musical tone signal generating portion 8 as the musical tone signal control information MUS. By executing the key-on process on the assigned channel, the musical tone signal generating portion 8 sends the musical tone signal SND to the sound system 10 via the tone color control portion 9.

Figure 3:
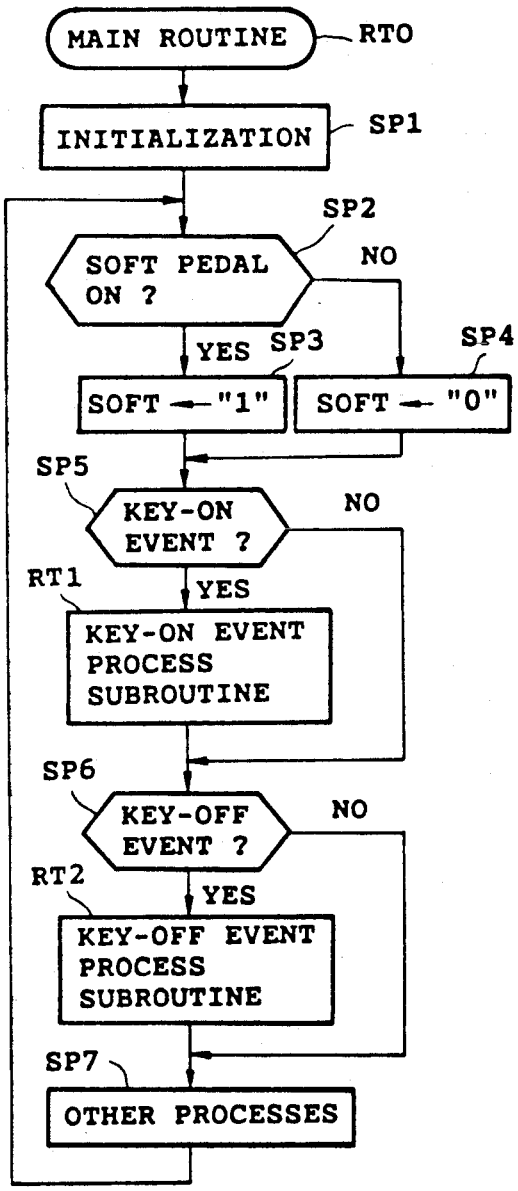
FIGS. 3, 4 and 5 are flowcharts respectively showing a main routine, a key-on event process subroutine and a key-off event process subroutine of a CPU shown in FIG. 1.
Figure 4:
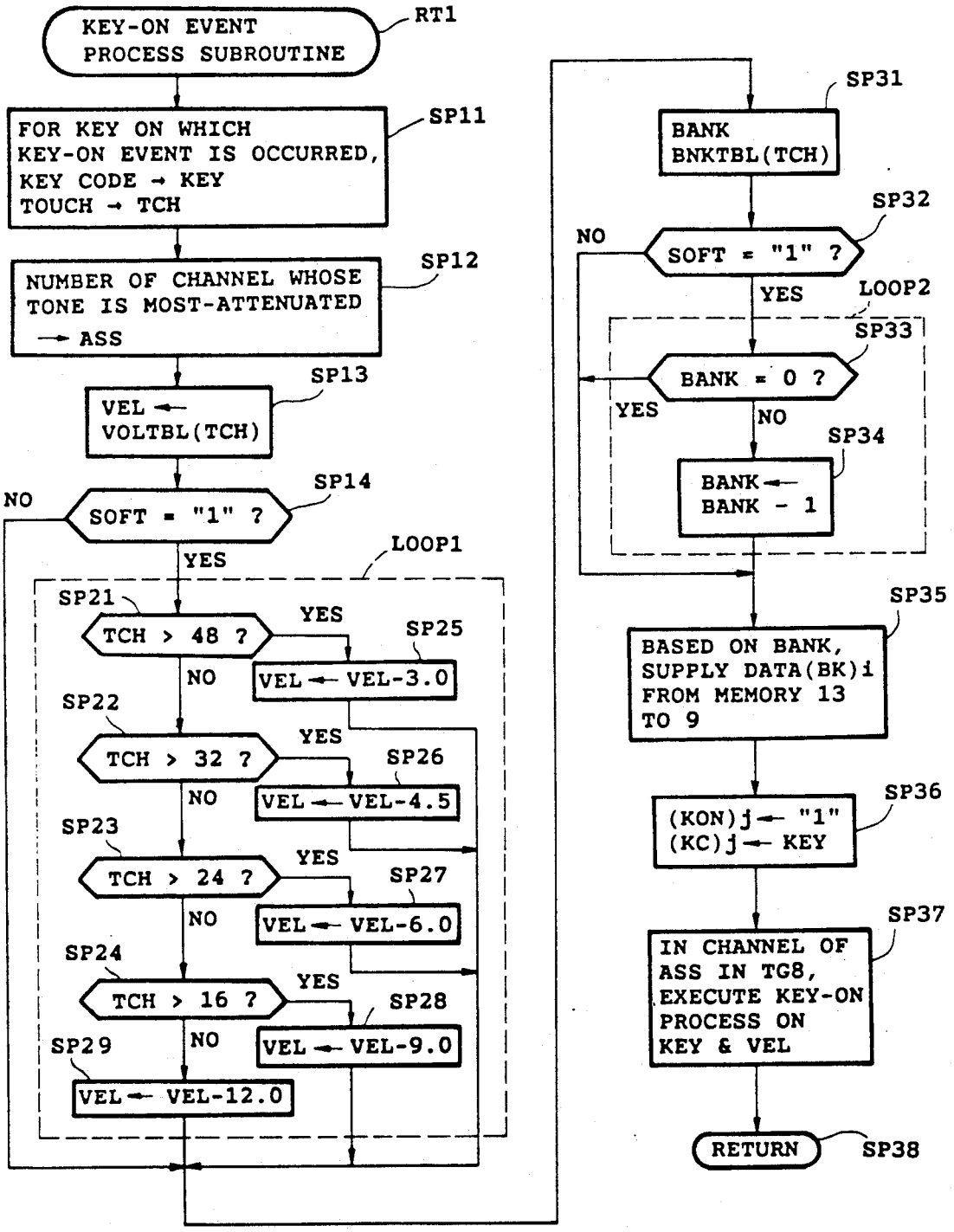

As described above, the CPU 5 completes the key-on event process subroutine, so that the processing returns to the main routine (see FIG. 3) from step SP38 (shown in FIG. 4).

In the flowchart shown in FIG. 4, when the key-on event is occurred on any key in the state where the register RG5 stores the key-depression velocity data VEL corresponding to the present touch operation quantity given by the player in the foregoing step SP13, the CPU 5 executes the softening process on the generated musical tone with respect to its tone volume or tone color independently when the player operates the soft pedal on.

In other words, when the player operates the soft pedal on, the processing of the CPU 5 enters into the tone volume softening process loop LOOP1 wherein the CPU 5 executes the tone volume control by which the attenuation of the tone volume of the generated musical tone becomes larger as the touch operation quantity becomes smaller. In short, particularly in the relatively small range of the touch operation quantity, the tone volume is controlled to be lowered. Thus, it is possible to obtain the softening effect by which the soft impression can be effectively applied to the generated musical tone.

Next, in the foregoing step SP31, the filter characteristic selecting data BANK corresponding to the touch operation quantity is written into the register RG7, so that the desirable filter characteristic corresponding to the touch operation quantity is selected. Thereafter, when the soft pedal is operated on, the "−1" decrement operation is executed on the filter characteristic selecting data BANK, whereby the CPU 5 executes the tone color softening process by which the filter characteristic is varied such that the tone color is softened by predetermined one stage value.

In result, as compared to the case where the soft pedal is not operated, in the case where the soft pedal is operated, it is possible to obtain the softening effect by which the further soft impression can be given to the generated musical tone.

In contrast, when the player does not operate the soft pedal on, the sound system 10 generates the musical tone volume corresponding to the key-depression velocity data VEL and the tone color corresponding to the filter characteristic selecting data BANK, wherein the data VEL is determined in step SP13 and the data BANK is selected in step SP31. In short, the sound system 10 generates the musical tone having the tone volume and tone color on which the softening process is not executed.

(ii) Key-Off Event Process

Figure 5:
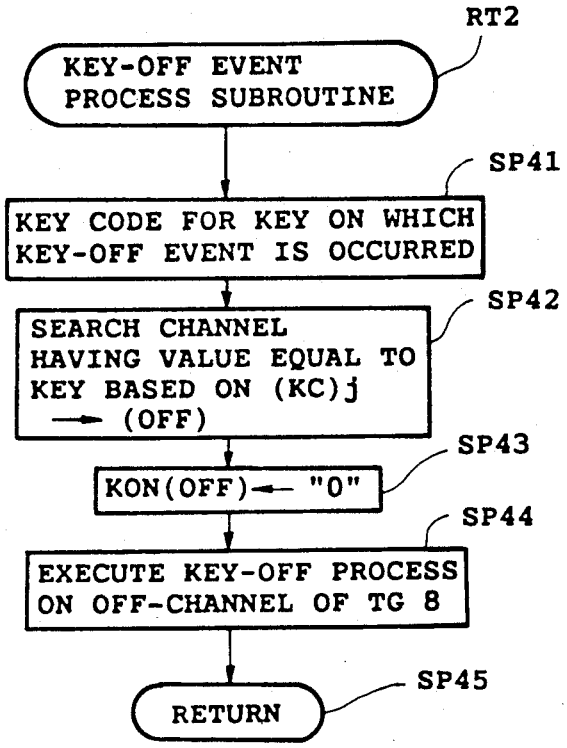

First, in the main routine RTO shown in FIG. 3, the processing of the CPU 5 enters into the key-off event process subroutine RT2 through which it proceeds to step SP41 shown in FIG. 5. In this step SP41, the key code of the key on which the key-off event is occurred is written into the register RG3 as the event key code data KEY. Thereafter, in step SP42, the CPU 5 searches the tone-generation channel whose value is equal to the event key code data KEY based on the key code data (KC)j (where j=0 to 15), and then the data indicative of the searched tone-generation channel is written into a key-off channel data register RG9 as key-off channel data OFF.

Next, the processing proceeds to step SP43 wherein the logical value "0" is set to the key-on data KON(-OFF) corresponding to the key-off channel data OFF among the key-on data (KON)j stored in the register RG2. Then, in step SP44, the CPU 5 executes the key-off process on the key-off channel in the musical tone signal generating portion 8.

Thus, the generation of the musical tone is terminated in the key-off channel. Thereafter, the processing of the CPU 5 returns to the main routine via step SP45.

Modified Examples of an Embodiment (1) In the above-mentioned embodiment, in order to rewrite the filter characteristic selecting data BANK in the foregoing step SP34 in the tone color softening process loop LOOP2 (see FIG. 4), "−1" decrement operation is executed on the data BANK so that the tone color is softened by the predetermined one stage value. However, the decrement value in the operation is not limited to "−1", so that it is possible to use another arbitrary value. For example, instead of this decrement value, it is possible to use another value which is determined in response to the variation of event key touch data TCH and the touch operation quantity.

(2) In the present embodiment, the common filter characteristic control data is used in the memory 13 when the soft pedal is operated on and off. Instead, it is possible to provide the filter characteristic control data which are exclusively used for the on or off operation of the soft pedal so that the desirable filter characteristic control data is selected in response to the on/off state of the soft pedal.

(3) In the present embodiment, when the key-depression velocity data VEL is rewritten in the foregoing steps SP25 to SP29 of the tone volume softening process loop LOOP1, the subtraction value (dB) thereof is determined based on the event key touch data TCH. However, it is possible to directly use the value of event key touch data TCH as the subtraction value.

(4) In the present embodiment, the common tone volume conversion table data VOLTBL(TCH) (see FIG. 6) is used in order to determine the tone volume of the musical tone in both cases where the soft pedal is operated on and off. Instead, it is possible to provide plural kinds of tone volume conversion data, each kind of which corresponds to each case.

(5) As the musical tone signal generating portion 8, it is possible to use any one of several kinds of tone sources such as the tone source using the waveform memory, frequency-modulation (FM) tone source and the like.

(6) In the present embodiment as shown in FIG. 1, the soft pedal effect applying apparatus according to this invention is assembled into one electronic musical instrument. However, this invention is not limited to such embodiment. So, it is possible to use the electronic musical instrument system which is assembled by plural components and whose one portion is configured as the soft pedal effect applying apparatus.

As described heretofore, according to the present invention, when the player operates the soft pedal on, the softening process can be executed on the tone volume and tone color of the generated musical tone independently. Therefore, when operating the soft pedal on, the soft pedal effect to be applied to the generated musical tone can be arbitrarily set with respect to the tone volume and tone color. For this reason, it is possible to obtain the soft pedal effect which is quite similar to that of the non-electronic (or natural) musical instrument such as the grand piano, so that the audio difference to be sensed between the electronic musical instrument and non-electronic musical instrument can be minimized with respect to the soft pedal effect.

This invention may be practiced or embodied in still other ways without departing from the spirit or essential character thereof as described in the modified examples. Therefore, the preferred embodiment described herein is illustrative and not restrictive, the scope of the invention being indicated by the appended claims and all variations which come within the meaning of the claims are intended to be embraced therein.

What is claimed is:

1. A soft pedal effect applying apparatus of an electronic musical instrument wherein a soft pedal effect is applied to a musical tone to be generated in accordance with operation of a soft pedal, said apparatus comprising:

(a) tone volume softening means for generating tone volume control information by which a tone volume of said musical tone to be generated is varied to a lower tone volume by a predetermined tone volume degree when it is detected that said soft pedal is operated; and (b) tone color softening means for generating tone color control information by which a tone color of said musical tone is varied to a softer tone color by a predetermined tone color degree when it is detected that said soft pedal is operated;

wherein said tone volume of said musical tone is varied by said tone volume control information from a reference tone volume which would be generated if said soft pedal were not operated, and wherein said tone color of said musical tone is varied by said tone color control information from a reference tone color which would be generated if said soft pedal were not operated, whereby the soft pedal effect is controlled independently with respect to tone volume and tone color.

2. A soft pedal effect applying apparatus according to claim 1 wherein said tone volume softening means forms said tone volume control information based on touch detection information indicative of touch operation quantity applied to a key, wherein when said touch operation quantity is in a range of relatively small quantities, said tone volume control information controls said tone volume of said musical tone to be reduced by a greater degree as said touch operation quantity becomes smaller.

3. A soft pedal effect applying apparatus for applying a soft pedal effect to a musical tone to be generated when a soft pedal is operated comprising:

(a) touch detecting means for detecting a touch operation intensity applied to a depressed key in a keyboard to thereby generate touch detection information;

(b) soft pedal detecting means for detecting whether or not said soft pedal is operated to thereby generate soft pedal information;

(c) means for selecting desirable one of predetermined tone volumes based on said touch detection information; and (d) control means for controlling a selected tone volume to be attenuated by desirable one of predetermined attenuation values when it is detected from said soft pedal information that said soft pedal is operated, wherein said attenuation value in the case where said touch operation intensity is relatively small is set larger as compared to that in the case where said touch operation intensity is relatively large, whereby said soft pedal effect is applied to said musical tone to be generated with respect to the tone volume.

4. A soft pedal effect applying apparatus for applying a soft pedal effect to a musical tone to be generated when a soft pedal is operated comprising:

(a) a touch detecting means for detecting a touch operation intensity applied to a depressed key in a keyboard to thereby generate touch detection information;

(b) soft pedal detecting means for detecting whether or not said soft pedal is operated to thereby generate soft pedal information;

(c) memory means for storing a plurality of filter characteristics grouped into plural stages and plural steps within each stage corresponding to said touch operation intensity;

(d) means for selecting one of said stages of filter characteristics based on said touch detection information to thereby obtain a desirably tone color; and (e) control means for changing from a selected filter characteristic stage to another filter characteristic stage which is softer than the selected filter characteristic stage when it is detected from said soft pedal information that said soft pedal is operated, so that said tone color is controlled to become softer as compared to a reference tone color which is generated when said soft pedal is not operated, whereby said soft pedal effect is applied to said musical tone to be generated with respect to said tone color.

5. A soft pedal effect applying apparatus for applying a soft pedal effect to a musical tone to be generated when a soft pedal is operated comprising:

(a) touch detecting means for detecting a touch operation intensity applied to a depressed key in a keyboard to thereby generate touch detection information;

(b) soft pedal detecting means for detecting whether or not said soft pedal is operated to thereby generate soft pedal information;

(c) conversion table means including (i) a tone volume conversion data table by which a desirable tone volume is selected from predetermined tone volumes based on said touch detection information, and (ii) a tone color conversion data table by which a desirable filter characteristic selecting data is obtained based on said touch detection information;

(d) memory means for pre-storing plural filter characteristic control data indicative of plural predetermined filter characteristics, one of which is to be selected based on said filter characteristic selecting data in order to obtain a desirable tone color; and (e) control means for controlling a selected tone volume to be attenuated by desirable one of predetermined attenuation values when it is detected from said soft pedal information that said soft pedal is operated, wherein said attenuation value in the case where said touch operation intensity is relatively small is set larger as compared to that in the case where said touch operation intensity is relatively large, said control means also changing a selected filter characteristic into another filter characteristic which is softer than the selected filter characteristic when it is detected from said soft pedal information that said soft pedal is operated, so that said tone color is controlled to become softer as compared to a reference tone color which is generated when said soft pedal is not operated, whereby said soft pedal effect is applied to said musical tone to be generated with respect to said tone volume and said tone color independently.

* * * * *